US005632126A

United States Patent [19]

Agsten

[11] Patent Number: 5,632,126

[45] Date of Patent: May 27, 1997

[54] WALL SYSTEM INVOLVING CORRUGATED PANELS FOR MAKING CONFINEMENT CELLS

[76] Inventor: Carl F. Agsten, 1539 Bedford Rd., Charleston, W. Va. 25314

[21] Appl. No.: 408,427

[22] Filed: Mar. 22, 1995

[51] Int. Cl.[6] ..... E04B 2/48

[52] U.S. Cl. ..... 52/426; 52/106; 52/783.19

[58] Field of Search ..... 52/106, 425, 426, 52/783.19

[56] References Cited

U.S. PATENT DOCUMENTS

| | | | |
|---|---|---|---|
| 1,035,206 | 8/1912 | Lewen . | |
| 1,879,319 | 9/1932 | Kleitz | 109/80 |
| 1,956,354 | 4/1934 | Junkers . | |
| 2,356,309 | 8/1944 | Garbe . | |
| 2,873,008 | 2/1959 | Ashman | 52/783.19 X |
| 3,062,337 | 11/1962 | Zittle . | |
| 3,195,699 | 7/1965 | Johnston . | |
| 3,299,601 | 1/1967 | Chiville | 52/425 X |
| 3,583,123 | 6/1971 | Hehmgram et al. . | |
| 3,759,009 | 9/1973 | Ransome . | |
| 4,125,977 | 11/1978 | Michovic | 52/783.19 X |
| 4,718,214 | 1/1988 | Waggoner | 52/783.19 |
| 4,843,788 | 7/1989 | Gavin et al. | 52/106 X |
| 5,400,553 | 3/1995 | Brennan | 52/106 |

FOREIGN PATENT DOCUMENTS

| | | | |
|---|---|---|---|
| 142874 | 8/1951 | Australia | 52/426 |
| 404166541 | 6/1992 | Japan | 52/783.19 |
| 44513 | 6/1961 | Poland | 52/783.19 |

*Primary Examiner*—Carl D. Friedman
*Assistant Examiner*—Yvonne Horton-Richardson

[57] ABSTRACT

A system, panel and method are provided for constructing confinement cells such as jail and prison cells. The panels have a face plate and a corrugated sheet having holes for fluid concrete flow therethrough. The panels are designed to be interconnected to act as concrete forms, and the face plates have flanged side edges to minimize the presence of recesses therein. The face plates are preferably chemically treated to promote adherence to of the concrete thereto.

15 Claims, 3 Drawing Sheets

FIG. 5
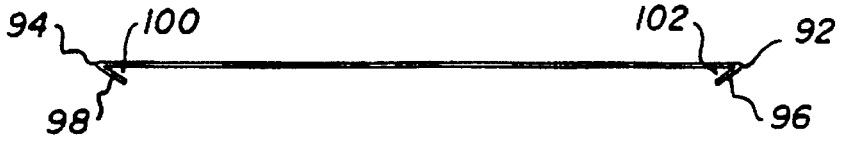
FIG. 6
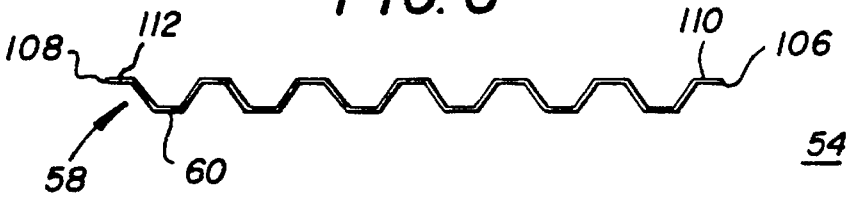
FIG. 7
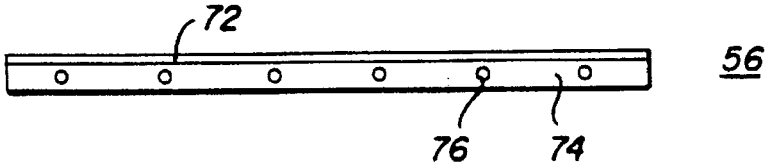
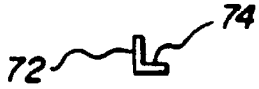
FIG. 8
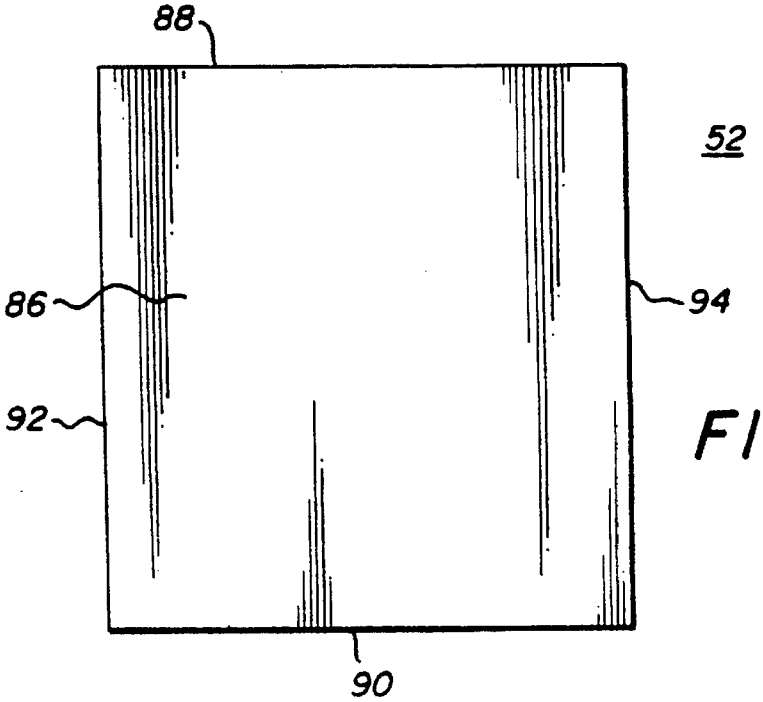
FIG. 9

WALL SYSTEM INVOLVING CORRUGATED PANELS FOR MAKING CONFINEMENT CELLS

BACKGROUND OF THE INVENTION

1. Field of the Invention

The present invention relates to building systems, methods and wall panels, and more particularly relates to building systems, methods and wall panels for making confinement cells.

2. Description of the Related Art

Confinement cells, namely prison and jail cells, require special considerations that are not generally considered for conventional commercial building systems, methods and wall panels. Specifically, the building systems, methods and wall panels should be constructed to (a) resist destruction from inmates, (b) resist conversion to weapons such as metal knives, and (c) minimize recesses for hiding materials such as razor blades and other contraband. Additionally useful building panels should be light weight, rigid and easily stackable, and building systems and methods should be simple and cost efficient.

Prior methods for constructing prison and jail cells include conventional cast-in-place concrete cell walls, cast-in-place concrete cell walls using tunnel forms, precast concrete panel cell walls, complete precast concrete uni-cast cells, reinforced concrete masonry units (CMU) cell walls, and steel cell units, each of which has various disadvantages. Specifically, conventionally cast-in-place concrete cell walls typically use forming materials such as wood or heavy steel panels, or a combination thereof, both of which, regardless of the supporting framing and bracing systems, are relatively heavy and very labor intensive. Additionally, conventionally cast-in-place concrete cell walls typically require many man-hours for both installation and stripping and for customizing to accommodate the required items that must be interfaced, such as sleeves and devices for mechanical systems, electrical systems and weld plates for jail furnishings, and additionally, the installation of the security windows and door frames (which must be very precise in plumbness and squareness), requires many additional man-hours. Additionally, such cast-in-place systems typically leave "form marks" on the surface and at the panel joints that usually require much additional work, such as scraping, patching and rubbing, to make them acceptable in appearance and function.

Cast-in-place concrete cell walls using tunnel forms generally suffer the major disadvantage of high initial investment cost, and often cost in modification thereof, in the form itself, which generally must be purchased or leased by the contractor. An additional disadvantage of tunnel forms, typically includes the need to utilize a large crane in order to handle the huge, heavy forms. Additionally only three wall units can be cast with this tunnel form and the remaining wall, either the one with the windows or the one containing the security doors, must be constructed using some other method.

Precast concrete panel cell walls utilize flat precast concrete panels, usually cast in a plant, generally suffer the disadvantage of transport costs, heavy lifting equipment for erection, the relatively large number of precast pieces required for each unit, and the work required to satisfactorily seal the resulting joints where the pieces come together.

Complete precast concrete uni-cast cells employs complete cell units that are precast in a plant, and generally suffer from the disadvantage of including very high cost of transportation, and the high expense of the initial casting forms for creating such units, and again require heavy and expensive equipment for loading, hauling the oversized loads and setting them in a place.

The reinforced concrete masonry units (CMU) cell walls involve a method where the cell walls are laid up with conventional concrete masonry units, and vertical reinforcing steel rods are placed in the cells of the blocks at some designated centers and the blocks are then filled full of concrete grout. The disadvantages of such CMU cell walls include that the walls have generally slightly less structural value than concrete walls, they may lack in various security aspects, are very labor intensive in construction, generally requires skilled labor, and the small size of the jail cells makes the scaffolding and materials handling difficult and costly. Additionally, the number of cut (individually sawed) pieces required to accommodate devices and openings is also a major cost disadvantage, and additionally there are sometimes problems associated with the maintaining of the required close tolerance for the cell door frames.

Steel cell units are generally manufactured in a plant, generally suffer from the disadvantage of high cost, as well as various limitations with regard to utilization as an integral part of structural systems for large buildings.

Accordingly, there is a need and desire to provide building systems, methods and panels which resist conversion to weapons, resist destruction from inmates, minimize orifices for hiding materials, are light weight, rigid and easily stackable for transport, and are easy to assemble and cost efficient.

SUMMARY OF THE INVENTION

A wall system, panel, cell and method are provided for constructing confinement cells. The panels are rigid, light weight, easily stackable for transport, and can be easily configured into a system sectional unit which may be filled with concrete to form cell walls. The panel has a face plate which is preferably chemically treated to facilitate adhesion to concrete. The panel also has a corrugated sheet attached to the face plate for rigidity, and the corrugation have holes therein for concrete to flow therethrough into contact with the face plate. The panels are constructed for complete linear abutment to adjacent panels and for flow of concrete to a position immediately adjacent the outer surface of the face plate adjacent the abutment. The method involves (a) making a panel, (b) horizontally spacing apart panels; and (c) delivering fluid concrete between the panels. The method, system and panels are especially useful for making confinement cells such as prison cells and jail cells.

BRIEF DESCRIPTION OF THE DRAWINGS

FIG. 5 is a top plan view of a vertical face plate of a unit according to FIG. 3;

FIG. 6 is a top plan view of a vertical corrugated sheet of a unit according to FIG. 3;

FIG. 7 is s a top plan view of a horizontal reinforcement member of a unit according to FIG. 3;

FIG. 8 is a side elevational view of an end of the horizontal reinforcement member of FIG. 7;

FIG.9 is a front elevational view of the vertical fate plate of FIG. 5;

DETAILED DESCRIPTION OF THE INVENTION

Figure 1:
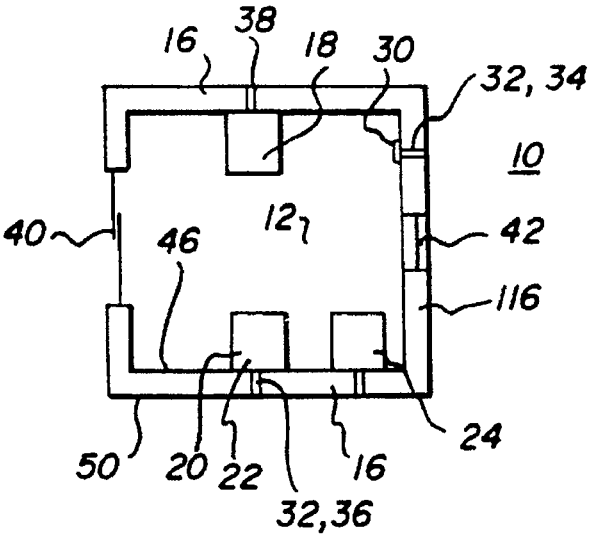
FIG. 1. is a top plan view of a confinement cell made according to the present invention.
Figure 2:
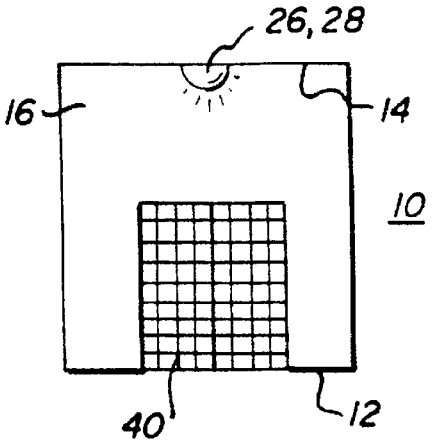
FIG. 2 is a front elevational view of the confinement cell of FIG. 1.

As shown in FIGS. 1 and 2, a prison (confinement, jail) cell (10) is provided comprising a floor (12), a ceiling (14), and at least one wall (16) interconnecting the floor (12) and ceiling (14). The cell may optionally contain furniture (18), plumbing fixtures (20) such as a sink (22) and a toilet (24), and electrical fixtures (26) such as a light (28) and electrical outlets (30). The wall may contain at least one sealed sleeve (32) for electrical wiring (34) and/or piping (36) (water and sewer), and may contain at least one anchor (38) for securing attachment of the furniture to the wall (16). Preferably the cell (10) is rectangular in shape and has four walls (16). The cell also has a security cell door (40) and may optionally have security windows (42).

The wall (16) includes a series of first panel sections (44) forming the interior wall surface (46) of the cell (10), and a series of second panel sections (48) forming the exterior wall surface (50) of the cell (10). It is understood that for adjacent cells (10) that the exterior surface (50) of the cell being described, can actually also be the interior surface of the adjacent cell.

Figure 3:
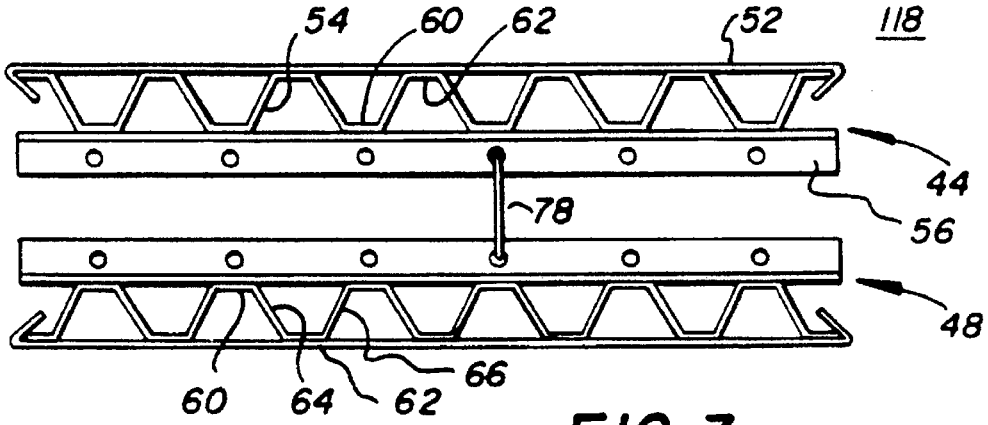
FIG. 3 is a top plan view of a vertical system wall unit for making a wall of the confinement cell.
Figure 4:
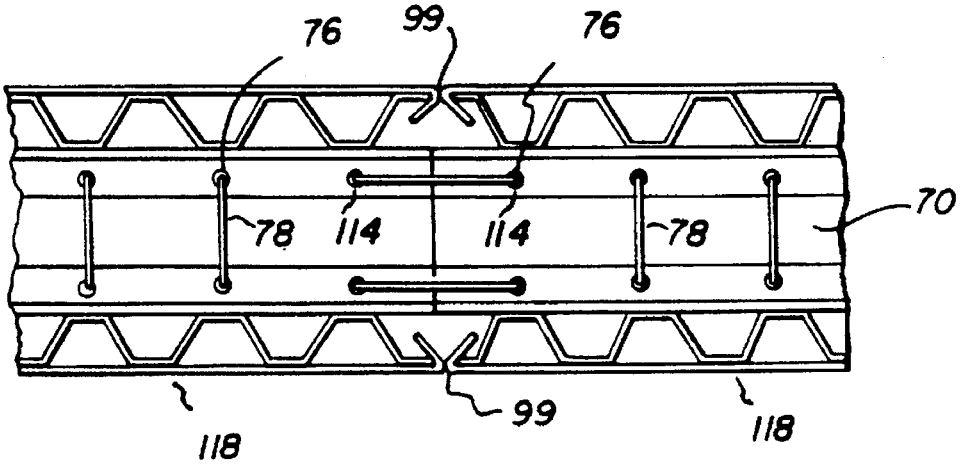
FIG. 4 is a top plan view of two abutting vertical system wall units according to FIG. 3.
Figure 12:
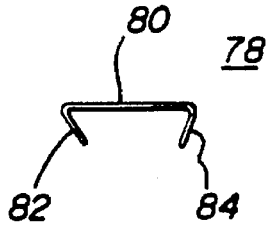
FIG. 12 is an elevational view of a uniting rod.
Figure 11:
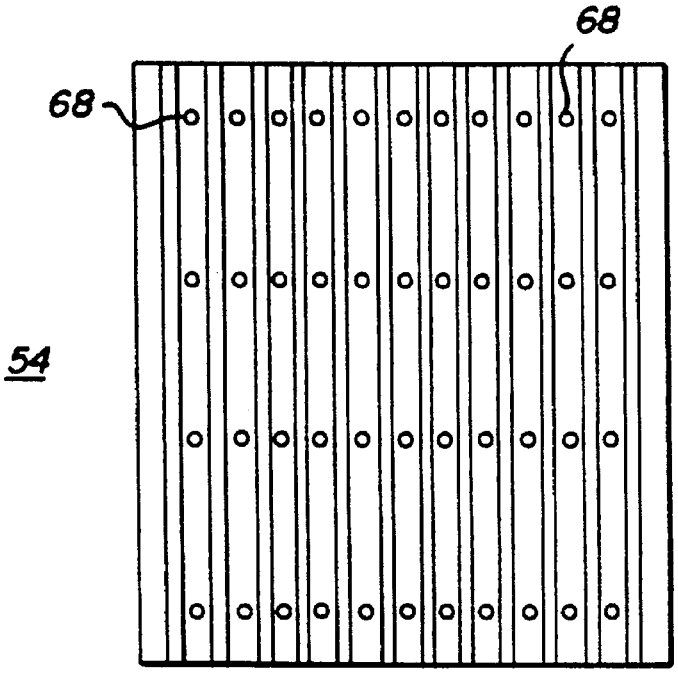
FIG. 11 is a front elevational view of the vertical corrugated sheet of FIG. 6.
Figure 13:
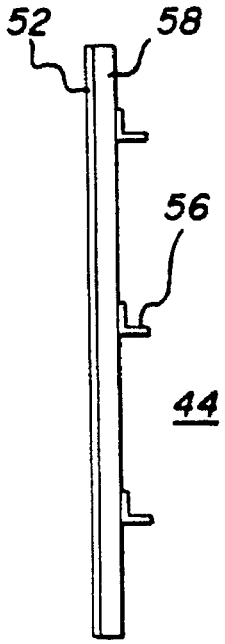
FIG. 13 is a side elevational view of a vertical first panel section of a unit according to FIG. 3.

As shown in FIG. 13, the first panel sections (44) include (a) a face plate (52), (b) a corrugated sheet (54), and reinforcement member (56). The face plate (52) provides the interior wall surface (46). The face plate (52) is adhered to the corrugated sheet (54) by spot weld or other suitable means. The corrugated sheet (54) includes a series of elongated corrugations (58) each having an elongated apex (60), a base (62), a first side segment (64) extending from the base (62) to the apex (60), and a second side segment (66) extending from the apex (60) to an adjacent corrugation base. As shown in FIG. 11, the corrugation includes a plurality of holes (68) along the length thereof for fluid flow therethrough and into the space (70) between the apex (60) and the face plate (52). The back side (104) (the internal side of the wall (16), the side adjacent the corrugated sheet (54)) of the face plate (52) which will come into contact with the concrete, is preferably chemically treated to promote adhesion of the concrete thereto. The reinforcement member (56) is preferably in the form of an L-shaped angle iron and extends transverse (perpendicular) to the apex (60) of the corrugation (58) and is attached thereto by spot welding or other suitable means. As shown in FIGS. 7 and 8, the reinforcement member (56) preferably has a first planar element (72) parallel to the face plate (52) and attached to the apexes (60), and a second planar element (74) perpendicular to the first planar element (72) and extending outwardly (away) from the corrugated sheet (54) thereby giving the reinforcement member (56) an L-shaped cross-section. As shown in FIGS. 3 and 4, the reinforcement member (56) has a plurality of orifices (76), preferably evenly spaced and preferably in the horizontal element (74) for receiving a uniting rod (78). As shown in FIG. 12, the uniting rod (78) has a horizontal segment (80), a downwardly and inwardly extending first finger (82), at one end of the horizontal segment (80), and a downwardly and inwardly extending section finger (84) at another end of the horizontal segment (80).

Figure 10:
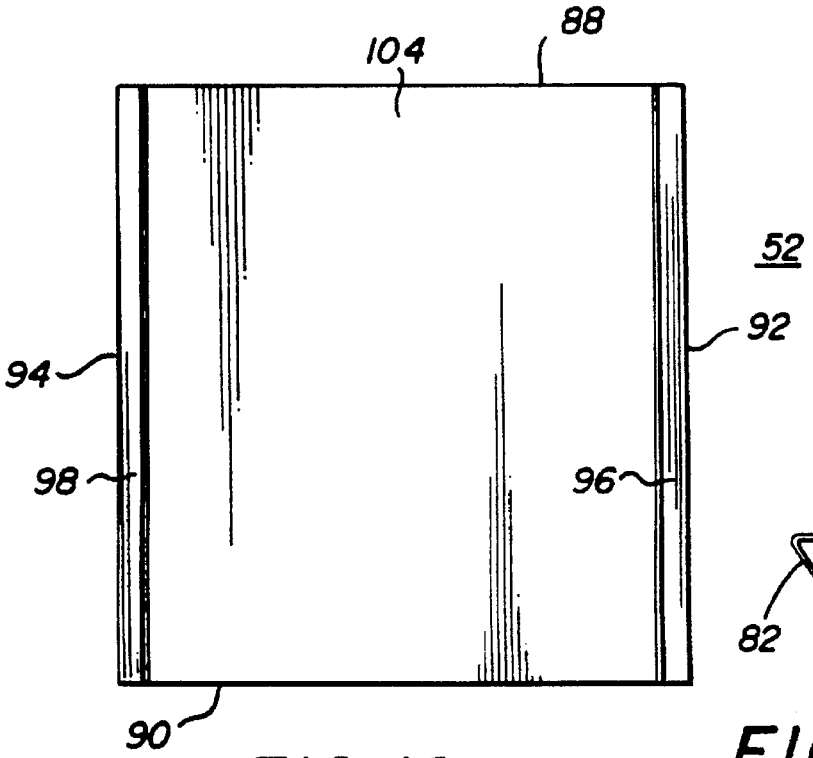
FIG. 10 is a rear elevational view of the vertical face plate of FIG. 5.

As shown in FIGS. 5, 9 and 10, the face plate (52) is preferably flat, planar and smooth at its outer surface (86). The face plate (52) is rectangular in shape and has a top edge (88) to be positioned adjacent the ceiling (14), a bottom edge (90) to be placed adjacent the floor (12), and a pair of side edges (92, 94). Each side edge (92, 94) has an inwardly and rearwardly extending flange (96, 98) respectively. The flanges (96, 98) each form an acute angle (100,102) respectively, preferably from 10° to 60°, more preferably from 20° to 50°, relative to the internal surface (104) of the face plate (52).

As shown in FIGS. 6 and 11, the corrugated sheet (54) has outer side edges (106, 108) which are formed by outermost flat bases (110, 112). The bases (62), apexes (60), and segments (64, 66) are preferably flat and elongated and rectangular in shape. For a given corrugated sheet (54), the bases (62) lie in a single plane, and the apexes (60) lie in another single plane.

The first panel sections (44) are made by assembling the face plate (52) and corrugated sheet (54) and spot welding (attaching) the bases (62) of the sheet (54) to the plate (52). The reinforcement member (56) is then spot welded (attached) to the apex (60) of the corrugated sheet (54).

The second panel section preferably has a face plate (52), but may optionally not have the face plate (52) provided that the second panel will not form the interior surface of a cell (10).

The system wall unit (118) is formed by horizontally spacing a first vertical panel section (44) and a second vertical panel section (48), and interconnecting the two panel sections by inserting respective fingers (82, 84) of uniting rod (78) into respective orifices (76) of the first and second panel sections (44, 48). The uniting rod (78) serves to maintain the spaced relationship of the first and second panel sections (44, 48) and prevents forces applied by the fluid concrete to further separate the panel sections (44, 48). The angled inward orientation of the fingers (82, 84) inhibits uninterrupted upward ejection of the rod (78) from the orifices (76). The outermost side orifices (114) may be used to interconnect adjacent side panels. As shown in FIG. 3, a plurality of horizontal vertically spaced L-shaped angle irons (56) may be present on each panel opposite and parallel to respective L-shaped angle irons its respective spaced apart panel for providing multiple levels of spacing control by the uniting rods (78).

The cell walls (10) may be formed by placing a series of vertical first panels (44) with the face plate thereof serving as the cell interior (46), and spacing therefrom a series of second panels (48) as the cell exterior (50); interconnecting the spaced apart panels (44, 48) with uniting rods (78); and delivering fluid concrete between the spaced apart panels (44, 48). The fluid concrete will flow between the apex (60) and the face plate (52) through the hole (68) and will adhere to the chemically treated back side (104) of the face plate (52) to prevent inmates from tearing or cutting away a section of the face plate (52). The side edges (92, 94) of the face plates abut to prevent the formation of a recess for hiding objects, and the acute angle of the flanges (96, 98) allows for concrete to flow to the point of face plate (52) abutment (99) to further prevent the formation of a recess at the point of abutment (99). The walls (16) may be constructed by using the panels (44, 48) as permanent concrete forms, thereby allowing for easy assembly without the transport weight of premade concrete walls. The cast in place walls also allow for the avoidance of costly form rental and avoids the marks left by conventional forms and the related post-forming steps required to remove and/or patch such markings.

The face plate (52) is preferably made of sheet metal, such as stainless steel, pre-finished steel or aluminum. The corrugated sheet (54) is preferably made of steel. The L-shaped angle iron is preferably made of steel. The uniting rods (78) are preferably made of spring steel.

The present method, panels and system provides for load bearing walls for confinement cells which may be erected to form the structural framework of a building, such as a prison or jail. If the system, method or panels are used for commercial structures, such as office buildings, the face plate may be omitted and other appropriate materials substituted, such as gypsum wallboard for intercore and brick or stucco for exteriors. The corrugations of the panels are hidden from view when in the final wall.

The wall thickness is preferably between 6 inches and 2 feet, and more preferably between 8 inches and 12 inches. The depth of the corrugations is preferably between 1 inch and 3 inches, and more preferably from 1.5 inches to 2.5 inches as measured by the height of the apex. The face plate is preferably made of mild steel and is preferably of a thickness of between 20 and 30 gauge. The cement or concrete preferably has a density of at least 90 lb/cubic foot, and more preferably between 115 and 150 lb/cubic foot. Preferably each base and apex has a width of at least 1 inch, more preferably between 1.5 and 3 inches to facilitate welding of the face plate and angle iron, respectively, thereto. The solidified concrete (116) provides a rigid, structural matrix within the wall (16).

The present invention has numerous advantages including: (1) the system pieces such as the panels, are relatively light in weight and can be easily handled by one worker without the use of any lifting equipment; (2) the panels are relatively slim and flat and light weight, so large quantities can be shipped in one load, thus resulting in lower transport costs; (3) system can be assembled on the job without use of cranes or forklifts, and very minimal (or no) bracing is required to hold the panels in place, and the concrete or grout can be pumped into the forms (slowly), requiring only a small grout pump, and the speed of erecting these panels is far superior to cast-in-place concrete due to limited number of steps, and to the masonry due to far less pieces to place; (4) everything that interfaces with the wall is easily accommodated, including electrical devices and conduits which may be installed in a conventional manner, and door frames and windows, which can be easily detailed to fit perfectly with the panels, and furniture and other embedded items can be placed with anchors into the walls before the concrete is placed, eliminating the need for welding, and the furniture and frames can even be prefinished without fear of damage with only minimal protection; (5) after the walls are filled and cured, there is no stripping of forms to be done, and the walls are finished, a light protective film that comes on the flat steel sheets that the face plate (skin) is made from, is pealed from the face of the wall in a baked on enamel (or other paint product) on the outer surface of the face plate may be present; (6) and clean up cost is minimal, if not almost nonexistent.

In summary, the present invention has numerous advantages including (a) low shipping costs, (b) no heavy cranes, trucks or forklifts are necessary, (c) construction may be done quickly, (d) no fancy shop drawings requiring interfacing of electrical and mechanical work needs to be employed, (e) minimal clean-up, (f) a beautiful color prefinished wall surface may be present, and (g) all this may be done at a competitive, if not lowest in place cost.

Suitable adhesives include rubber type adhesives such as polychloroprene adhesives, and more preferably magnesium resinate/polychloroprene adhesive such as 3M's SCOTCH-GRIP 1300 Rubber and Gasket Adhesive which is commercially available, and is set out as containing 20 to 30 weight percent petroleum distillate, 20 to 30 weight percent methyl ethyl ketone, 20 to 30 weight percent magnesium resinate, 10 to 20 weight percent polychloroprene, 5 to 10 weight percent n-hexane and 5 to 10 weight percent toluene.

I claim:

1. A prison cell comprising:

(a) a floor, (b) a ceiling, and (c) at least one wall, said wall having a first panel, and a second panel each having a horizontal member having an orifice, said first panel comprising (i) a face plate, and (ii) a corrugated sheet attached to said face plate, said corrugated sheet having a series of corrugations, said corrugations each having an apex, a base and sloped portion extending from said base to said apex, said apex being horizontally spaced apart from said plate, said corrugations having holes therein to allow for flow of wet concrete into the space between said apex and said plate from between said panels, said first panel and second panel are interconnected by a uniting rod having a horizontal mid segment, a downwardly and inwardly extending first finger adjacent said first panel and declining away therefrom, and a downwardly and inwardly extending second finger adjacent said second panel and declining away therefrom, said first finger being inserted into said orifice of said horizontal member of said first panel, and said second finger being inserted into said orifice of said horizontal member of said second panel.

2. A wall unit comprising: (a) a first panel, (b) a second panel, (c) means for interconnecting said first panel and said second panel, (d) concrete between said first and second panels, wherein said first panel has a horizontal member having an orifice, said second panel having a horizontal member having an orifice, said means for interconnecting comprising a uniting rod having a horizontal midsegment, a downwardly and inwardly extending first finger adjacent said first panel and declining away therefrom, and a downwardly and inwardly extending second finger adjacent said second panel and declining away therefrom, said first finger being inserted into said orifice of said horizontal member of said first panel, and said second finger being inserted into said orifice of said horizontal member of said second panel.

3. The unit of claim 2 wherein said concrete is chemically adhered to said panels.

4. The unit of claim 2 wherein said first panel comprises (a) a flat face plate, and (b) a corrugated sheet having a series of corrugations, said corrugations each having a base segment, an apex segment, a first side segment inclining from said base segment to said apex segment, a second side segment declining from said apex segment, each of said corrugations having holes therein for fluid flow of wet concrete therethrough to fill between said apex and said face plate.

5. The unit of claim 4 wherein said face plate has a rearwardly and inwardly extending flange which forms an acute angle recess that receives a base segment of said sheet.

6. A panel for prison wall construction, said panel comprising: (a) a face plate, (b) a corrugated sheet comprising a series of corrugations, each of said corrugations comprising a base segment, an apex segment, a first side segment inclining from said base to said apex, and a second side segment declining form said apex to an adjacent corrugation, said apex being horizontally spaced apart from said face plate, said corrugations each having at least one orifice for allowing fluid concrete to flow through said orifice and between said apex and said face plate, and an angle iron interconnecting said apexes for reinforcement of said panel.

7. The panel of claim 6 wherein said face plate has a rearwardly and inwardly extending flange which forms an acute angle recess that receives a base portion of said sheet.

8. A method for constructing a confinement cell wall sectional unit, said method comprising:

(a) making a first panel section comprising:
(i) a face plate,
(ii) a corrugated sheet comprising corrugations having holes therein for fluid flow therethrough, (b) horizontally spacing said first panel section in a vertical orientation from a vertical second panel section in an interconnected fashion to restrict horizontal movement away from said second panel section, (c) delivering fluid concrete between said panels and allowing the fluid to flow through the corrugation holes.

9. The method of claim 13 wherein said face plate is chemically treated to promote adherence of the concrete thereto.

10. A wall unit comprising:

(a) a first panel having; (a) a face plate; (b) a corrugated sheet having a series of elongated corrugations having apexes; a reinforcement member attached to said apexes; said reinforcement member, attached to said first panel, having a plurality of orifices;

(b) a second corrugated panel having (a) a face plate; (b) a corrugated sheet having a series of elongated corrugation having apexes; a reinforcement member attached to said apexes of said second corrugated panel; said reinforcement member, attached to said first panel, having a plurality of orifices;

(c) means for interconnecting said first panel to said second panel; said interconnecting means having a first finger inserted in an orifice of said reinforcement member attached to said first panel and having a second finger inserted in an orifice of said reinforcement member attached to said second panel.

11. The wall unit of claim 10 wherein said reinforcement members are angle irons.

12. The wall unit of claim 11 wherein said angle irons are L-shaped angle irons.

13. A method for constructing a wall comprising:

(a) providing a first panel section comprising (i) a corrugated sheet comprising corrugations having apexes and (ii) a reinforcement member attached to said apexes, (b) providing a second panel section comprising (i) a corrugated sheet comprising corrugations having apexes and (ii) a reinforcement member attached to said apexes, (c) horizontally spacing said first panel section in a vertical orientation from said second panel section in an interconnected fashion to restrict horizontal movement of said first panel section away form said second panel section, (d) delivering fluid concrete between said panels and allowing said concrete to harden to form a wall comprising said panels and said concrete.

14. The method of claim 13 wherein said reinforcement members are L-shaped angle irons.

15. The method of claim 13 wherein said panels are interconnected by reinforcing rods.

* * * * *